US006848665B1

(12) United States Patent
Wu

(10) Patent No.: US 6,848,665 B1
(45) Date of Patent: Feb. 1, 2005

(54) PAPER HOLDER STRUCTURE

(76) Inventor: Ming-Tse Wu, No. 31, Lane 268, Hsin-Shu Rd., Hsin-chuang, Taipei (TW)

( * ) Notice: Subject to any disclaimer, the term of this patent is extended or adjusted under 35 U.S.C. 154(b) by 0 days.

(21) Appl. No.: 10/624,515

(22) Filed: Jul. 23, 2003

(51) Int. Cl.[7] ..... A47B 97/04
(52) U.S. Cl. ..... 248/459; 248/174
(58) Field of Search ..... 248/441.1, 450, 248/451, 453, 454, 459, 174; 206/45.26; 229/110, 109, 164

(56) References Cited

U.S. PATENT DOCUMENTS 1,681,586 A * 8/1928 Kessler ..... 248/473
3,119,194 A * 1/1964 Ray ..... 248/459
3,410,516 A * 11/1968 Criswell ..... 248/459
5,080,316 A * 1/1992 MacEwan ..... 248/459
5,388,798 A * 2/1995 Glick ..... 248/459

* cited by examiner

*Primary Examiner*—Ramon O Ramirez
(74) *Attorney, Agent, or Firm*—Troxell Law Office PLLC

(57) ABSTRACT

A paper holder structure made of a soft and magnetic sheet-shaped substrate formed with a central cut section and two extending sections extending downwardly from two lateral sides of the central cut section. The substrate is foldable about a central folding line to form front and a rear sections. A tail end of the central cut section is folded to form a connecting section for attaching the inner face of the rear section. After folded, the original position of the central cut section and the extending cut sections form a central hollow section and two extending hollow sections communicating with two lateral sides thereof. A middle projecting section is naturally defined between the two extending hollow sections. Papers are downward inserted into the two extending hollow sections from the central hollow section and the middle projecting section serves to press front side of the papers.

8 Claims, 5 Drawing Sheets

PAPER HOLDER STRUCTURE

BACKGROUND OF THE INVENTION

The present invention is related to an improved paper holder structure, and more particularly to a paper holder having simple structure and made at low cost. In addition, the paper holder can be conveniently used. After folded, the paper holder has small volume and can be easily stored.

FIG. 1 shows a conventional reading rack having a panel 3. A channel 31 is formed along the bottom edge of the panel 3 on front side thereof. A support leg 32 is disposed on back side of the panel 3. The support leg is pivotally turned to rearward downward obliquely extend for supporting the panel 3 in a slightly inclined state. A book or papers can be placed on the panel 3 and held in the channel 31 to stand in an inclined state for easy reading.

The panel 3 and the support legs 32 are made of hard plastic material by injection molding and thus have fixed shape and volume. When stored, the reading rack will occupy much room. In addition, the cost for the molds, injection molding procedure and assembly of such reading rack is high.

SUMMARY OF THE INVENTION

It is therefore a primary object of the present invention to provide a paper holder structure made of a soft and magnetic sheet-shaped substrate. The substrate is formed with a central folding line dividing the substrate into a front and a rear sections. The center of the substrate has a central cut section bridged between the front and rear sections. Two extending cut sections extend from two lateral sides of the central cut section toward lower side of the front section. The bottom edge of each extending cut section is formed with a bottom folding line. The substrate is foldable about the central folding line to form the front and rear sections containing a certain angle. The bottom edges of the front and rear sections outward downward extend as an oblique support. The central cut section and the extending cut sections are inward folded between the front and rear sections. A tail ends of the central cut section is upward reversely folded to form a connecting section for attracting the inner face of the rear section. The central cut section is bridged between the front and rear sections to support the same. After folded, the original position of the central cut section and extending cut sections respectively form a central hollow section and two extending hollow sections communicating with two lateral sides thereof. A middle projecting section is naturally defined between the two extending hollow sections. In use, papers are downward inserted into the two extending hollow sections from the central hollow section. The middle projecting section serves to press front side of the papers, whereby the papers are clamped on the front section in an oblique state for easy reading.

It is a further object of the present invention to provide the above paper holder structure in which the substrate is made of soft and magnetic sheet-shaped material. Therefore, the paper holder can be easily manufactured by folding and attraction without using any tool. When not used, the paper holder can be unfolded into a thin plane sheet for easy storage or carriage.

It is still a further object of the present invention to provide the above paper holder structure in which a clip plate is disposed on a plane portion of the rear section for clipping small area and lightweight papers such as a photograph or memos.

The present invention can be best understood through the following description and accompanying drawings wherein:

DETAILED DESCRIPTION OF THE PREFERRED EMBODIMENTS

Figure 2:
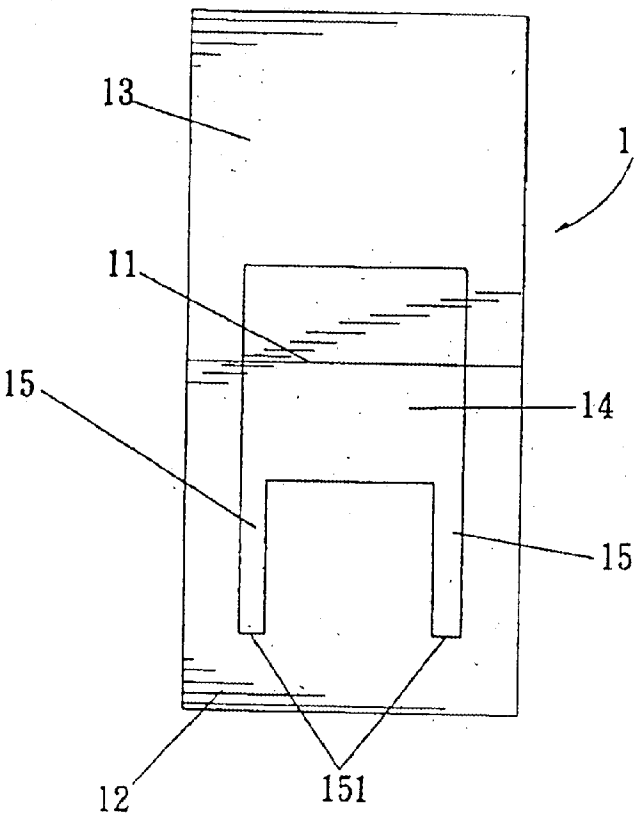
FIG. 2 is a plane unfolded view of the paper holder of the present invention.

Please refer to FIG. 2 which is a plane unfolded view of the present invention. The paper holder structure is made of a soft and magnetic sheet-shaped substrate 1. The substrate 1 is formed with a central folding line 11 dividing the substrate 1 into a front and a rear sections 12, 13. The center of the substrate 1 has a central cut section 14 bridged between two sides of the central folding line 11. Two extending cut sections 15 extend from two lateral sides of the central cut section 14 toward lower side of the front section 12. The bottom edge of each extending cut section 15 is formed with a bottom folding line 151.

Figure 1:
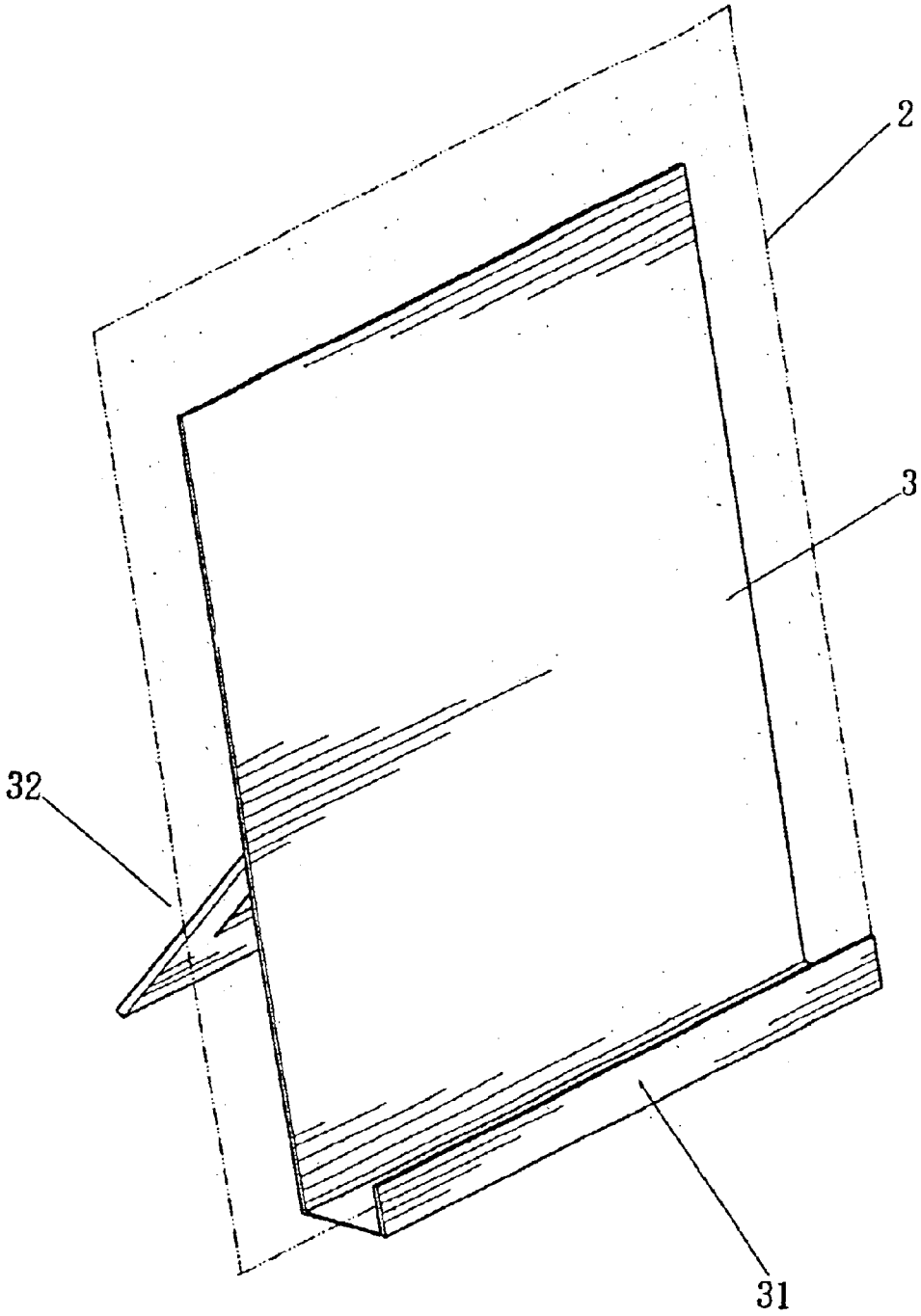
Fig. 1 Prior Art
FIG. 1 is a perspective view of a conventional reading rack structure.
Figure 3:
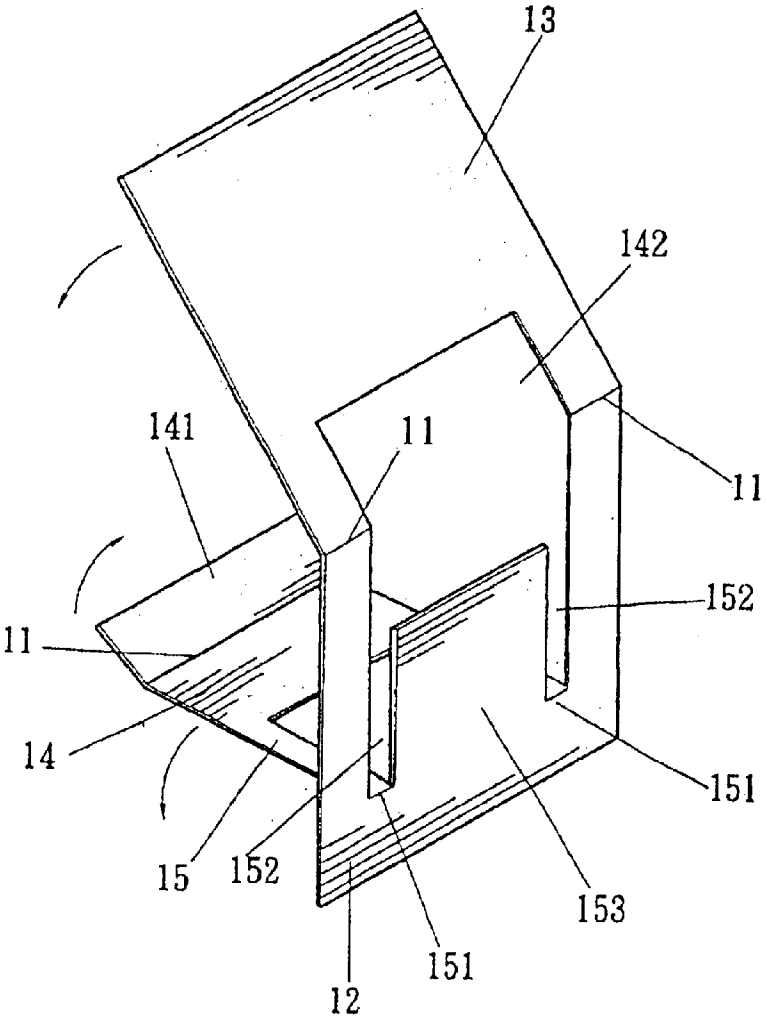
FIG. 3 shows that the paper holder of the present invention is folded.
Figure 4:
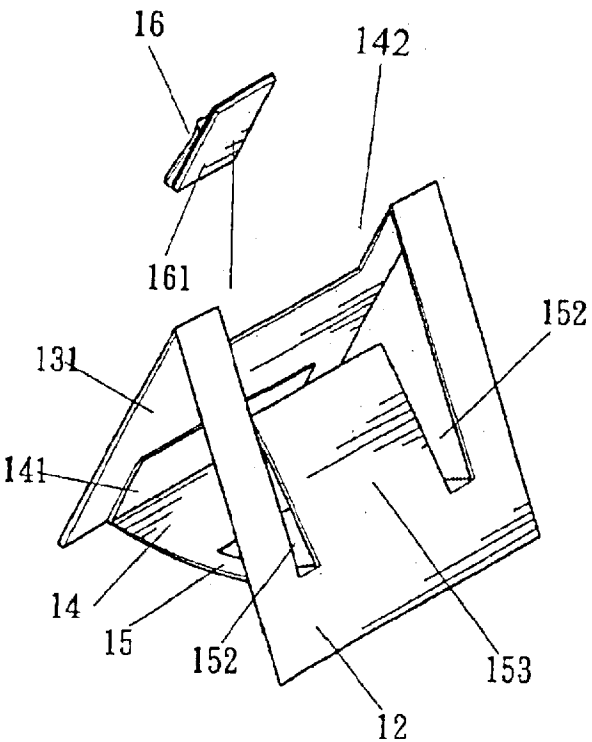
FIG. 4 is a perspective view of the folded paper holder of the present invention.
Figure 5:
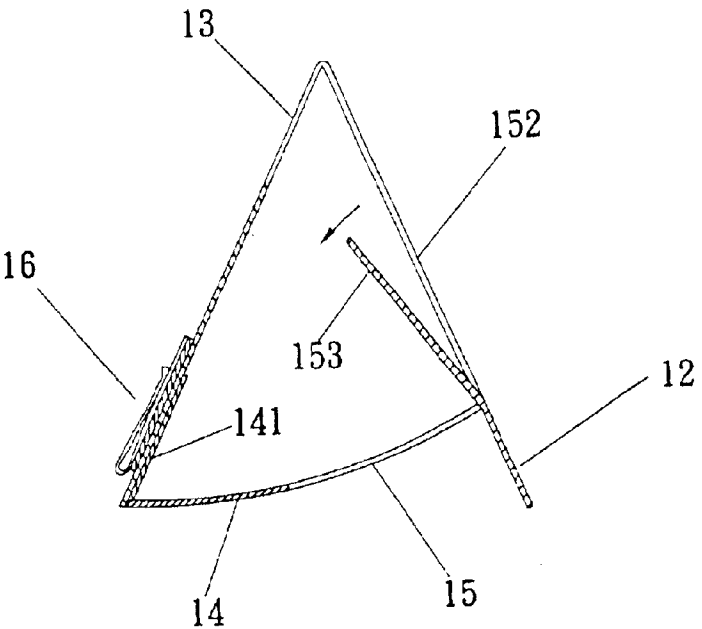
FIG. 5 is a side sectional view of the folded paper holder of the present invention according to FIG. 4.

FIGS. 3, 4 and 5 are perspective folded views of the present invention. The substrate 1 is folded about the central folding line 11, whereby the front and rear sections 12, 13 contain a certain angle. The bottom edges of the front and rear sections 12, 13 are stretched to obliquely support the paper holder. The central cut section 14 and the extending cut sections 15 are inward folded between the front and rear sections 12, 13. The tail end of the central cut section 14 (on outer side of the central folding line) is upward reversely folded to form a connecting section 141 for securing the inner face of the rear section 13 near the bottom edge thereof. Accordingly, the front and rear sections 12, 13 contain an angle and are obliquely supported. After folded, the original position of the central cut section 14 and extending cut sections 15 respectively form a central hollow section 142 and two extending hollow sections 152 communicating with two lateral sides thereof. A middle projecting section 153 is naturally defined between the two extending hollow sections 152. A hook or a clip plate 16 can be disposed on the plane straight portion of the outer face of the rear section 13. A magnetic pad 161 can be disposed on an attaching face of the clip plate 16 for detachably attaching to outer face of the rear section 13.

The substrate 1 of the paper holder structure is made of soft and magnetic material. Therefore, when the front and rear sections 12, 13 are placed on an iron (steel) desk face or other face, the central cut section 14 and the extending cut sections 15 on bottom side can provide a proper magnetic attraction force to more firmly locate the paper holder on the face.

Figure 6:
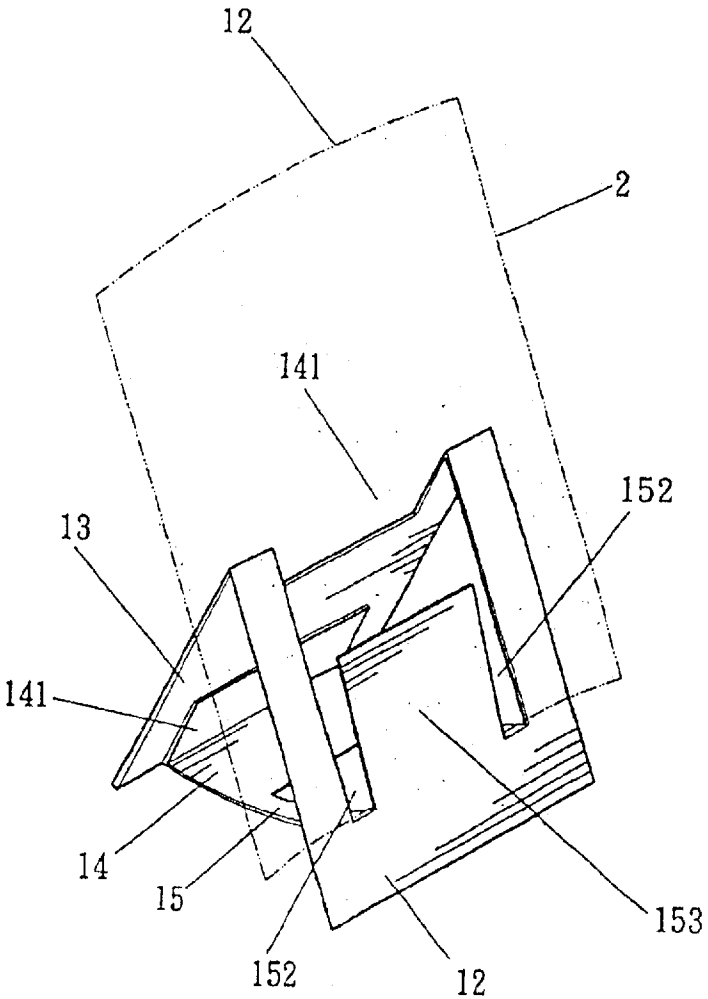
FIG. 6 is a perspective view showing that papers are held on the folded paper holder of the present invention.
Figure 7:
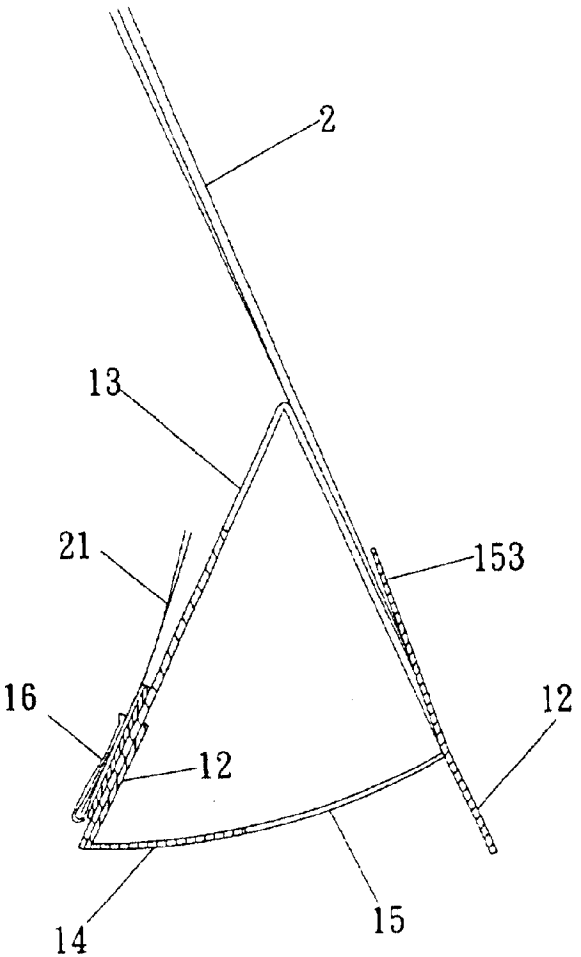
FIG. 7 is a side sectional view according to FIG. 6.

Please refer to FIGS. 6 and 7. In use, large papers 2 can be downward inserted into the two extending hollow sections 152 from the central hollow section 142. The middle projecting section 153 serves to press front side of the papers 2, whereby the back face of two lateral sides of the papers 2 abut against and attach to the outer sides of the two extending hollow sections 152 of the front section 12. Accordingly, the large papers 2 are clamped on the front section 12 in a slightly oblique state for easy reading. The clip plate 16 on the rear section 13 serves to clip small area and lightweight papers such as a photograph or memos.

Figure 8:
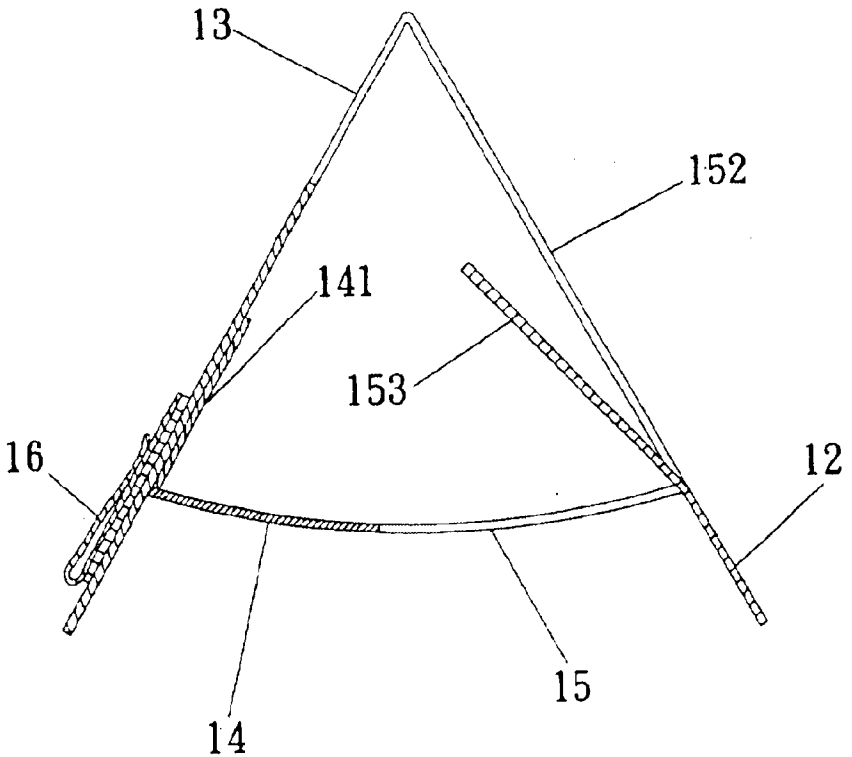
FIG. 8 is a side sectional view of the paper holder of the present invention, in which the front and rear sections are stretched by a larger angle.

FIG. 8 shows that the front and rear sections of the present invention are stretched by larger angle. The position where the connecting section 141 of the central cut section 14 attaches to inner wall of the rear section 13 can be changed so as to change the angle contained between the front and rear sections 12, 13. In FIG. 8, the connecting section 141 is moved upward to enlarge the angle contained between the front and rear sections 12, 13. Accordingly, the supporting state of the front and rear sections 12, 13 can be adjusted to achieve optimal viewing angle and stable location of the paper holder.

The paper holder of the present invention has simple structure and can be conveniently used. After folded, the paper holder has small volume and can be easily stored.

The above embodiments are only used to illustrate the present invention, not intended to limit the scope thereof. Many modifications of the above embodiments can be made without departing from the spirit of the present invention. For example, the middle projecting section 153 can be formed with a configuration of a specific article. Alternatively, the central hollow section 142 and the extending hollow sections 152 can have an area larger than the area of the central cut section 14 and the extending cut sections 12. Accordingly, when the paper holder is entirely unfolded and attached to a plane face, the paper holder serves as a simple photograph frame for clipping a picture or a photograph.

What is claimed is:

1. A paper holder structure made of a soft and magnetic sheet-shaped substrate, the substrate being having a central folding line dividing the substrate into a front and a rear sections, a center portion of the substrate has a central section, two extending cut sections extending from two lateral sides of the central cut section toward a lower side of the front section, the substrate being foldable about the central folding line to form the front and rear sections bottom edges of the front and rear sections extend downwardly as an oblique support, the central cut section and the extending cut sections fold inwardly between the front and rear sections, a tail end of the central cut section is upward reversely folded to form a connecting section for securing the inner face of the rear section, whereby the central cut section is bridged between the front and sections to support the same, after, folding the original position of the central cut section and extending cut sections respectively form a central hollow section and two extending hollow sections communicating with two laterals sides thereof, a middle projecting section defined between the two extending hollow sections, wherein papers are downwardly inserted into the two extending hollow sections from the central hollow section, the middle projecting section press the papers, clamping them on the front section in an oblique state for easy reading.

2. The paper holder structure as claimed in claim 1, wherein a hook or a clip plate is disposed on outer plane face of the rear section for clipping papers with small area.

3. The paper holder structure as claimed in claim 1, wherein the middle projecting section is formed with a configuration of a specific article.

4. The paper holder structure as claimed in claim 2, wherein the middle projecting section is formed with a configuration of a specific article.

5. The paper holder structure as claimed in claim 1, wherein the central hollow section and the extending hollow sections have a total area larger than a total area of the central cut section and the extending cut sections.

6. The paper holder structure as claimed in claim 2, wherein the central hollow section and the extending hollow sections have a total area larger than a total area of the central cut section and the extending cut sections.

7. The paper holder structure as claimed in claim 3, wherein the central hollow section and the extending hollow sections have a total area larger than a total area of the central cut section and the extending cut sections.

8. The paper holder structure as claimed in claim 4, wherein the central hollow section and the extending hollow sections have a total area larger than a total area of the central cut section and the extending cut sections.

* * * * *